US006044659A

United States Patent [19]

Ji

[11] Patent Number: 6,044,659

[45] Date of Patent: Apr. 4, 2000

[54] REFRIGERATOR HAVING A DEVICE FOR OPENING/CLOSING COOL AIR DISCHARGE PORTS

[75] Inventor: Joon Dong Ji, Suwon, Rep. of Korea

[73] Assignee: Samsung Electronics Co., Ltd., Suwon, Rep. of Korea

[21] Appl. No.: 09/124,255

[22] Filed: Jul. 29, 1998

[30] Foreign Application Priority Data

Jul. 31, 1997 [KR] Rep. of Korea ..... 97-36656

[51] Int. Cl.[7] ..... F25D 17/04

[52] U.S. Cl. ..... 62/408; 62/186

[58] Field of Search ..... 62/186, 187, 404, 62/407, 408, 441

[56] References Cited

U.S. PATENT DOCUMENTS

| | | | |
|---|---|---|---|
| 1,479,787 | 1/1924 | Clemans | 62/408 |
| 1,809,893 | 6/1931 | Flynn | 62/408 |
| 3,759,053 | 9/1973 | Swaneck | 62/157 |
| 4,614,092 | 9/1986 | Kim et al. | 62/408 |
| 4,688,393 | 8/1987 | Linstromberg et al. | 62/187 |
| 5,490,395 | 2/1996 | Williams et al. | 62/187 |
| 5,816,061 | 10/1998 | Lee et al. | 62/187 |
| 5,881,568 | 3/1999 | Kim | 62/443 |
| 5,884,496 | 3/1999 | Kim et al. | 62/186 |

*Primary Examiner*—William Doerrler
*Attorney, Agent, or Firm*—Burns, Doane, Swecker & Mathis, L.L.P.

[57] ABSTRACT

Disclosed is a refrigerator having a device for opening/closing cool air discharge ports through which cool air is supplied into a cooling compartment. In a cool air duct are installed shutter members for opening/closing the ports. The shutter members are installed a positions opening the ports, and are driven by a cam rotated by a motor. The ports and the shutter members are disposed symmetrically around the cam. As the cam rotates, the shutter members close the ports in turn. When a specific area becomes a desired temperature, a port corresponding to the specific area is closed by the shutter members. Thus, the area in the compartment to which cool air is supplied can be regulated, and the over-cooling of the compartment can be prevented.

8 Claims, 8 Drawing Sheets

REFRIGERATOR HAVING A DEVICE FOR OPENING/CLOSING COOL AIR DISCHARGE PORTS

This application claims priority under 35 U.S.C. §§119 and/or 365 to Application No. 97-36656 filed in Korea on Jul. 31, 1997; the entire content of which is hereby incorporated by reference.

BACKGROUND OF THE INVENTION

1. Field of the Invention

The present invention relates to a refrigerator, and more particularly, to a refrigerator having a device for opening/closing cool discharge ports through which cool air is supplied into a cooling compartment.

2. Prior Art

In general, a refrigerator has a cabinet for forming a pair of cooling compartments, i.e., a freezing compartment and a fresh food compartment which are partitioned by a partitioning wall, a freezing compartment door and a fresh food compartment door for opening/closing the cooling compartments respectively, and a cooling system for supplying the freezing compartment and the fresh food compartment with cool air which is comprised of a compressor, a condenser and an evaporator. The cool air generated by the evaporator flows along a supply duct formed in a rear wall of each compartment, and then is supplied into each cooling compartment by a blowing fan through cool air discharge ports opened thereinto.

In such a conventional refrigerator, however, there exist an area on which the cool air discharged through the cool air discharge ports is concentrated, and an area to which a relatively small amount of cool air is supplied, so there occurs a deviation of temperature in the cooling compartments and uniform cooling cannot be achieved. Therefore, the refrigerator adopting so called tri-dimensional cooling method which has amended such a problem has been proposed. In the refrigerator adopting the tri-dimensional cooling method, the cool air discharge ports are provided at both sides walls as well as the rear wall of the cooling compartment in order to promote the uniform cooling.

However, in such a refrigerator adopting the tri-dimensional cooling method, since the cool air is discharged through the cool air discharge ports in fixed directions, there may be a dead-zone at an edge area which is not supplied with the cool air sufficiently. In particular, since the supply duct has to be provided not only in the rear wall but also in the side walls, there are problems that the space for storing food is reduced and the manufacturing cost increases due to the increased number of components and processes.

The uniform distribution of cool air has risen to an important problem in relation to the trend to use large-sized refrigerator.

In consideration of such a problem, the applicant of this invention has proposed a refrigerator having a device for dispersing cool air in International Patent Application WO 95/27278. FIGS. 1 through 3 are a side view, a partial enlarged sectional view, and an exploded perspective view of main elements of the refrigerator having the device for dispersing cool air.

The conventional refrigerator having the device for dispersing cool air has a pair of cooling compartments 2 and 3 in a cabinet 1, which are partitioned from each other by a partitioning wall 5. The cooling compartments 2 and 3 are called a freezing compartment 2 of relatively low temperature and a fresh food compartment 3 of relatively high temperature. On the front opening of the cooling compartments 2 and 3, doors 6 and 7 for opening/closing them are installed respectively. In the cabinet 1 is installed a cooling system comprising a compressor 11, a condenser (not shown), a freezing compartment evaporator 12*a*, and a fresh food compartment evaporator 12*b*. The cool air generated from the evaporators 12*a* and 12*b* is supplied to the corresponding compartments 2 and 3 by a freezing compartment fan 13*a* and a fresh food compartment fan 13*b* respectively.

A duct plate 9 of partial cylinder shape having cool air discharge ports 16 opened to the fresh food compartment 3 is attached to an inner wall plate 23 forming a rear inner wall surface of the fresh food compartment 3, and a supply duct 15 and a return duct 17 separated from each other by a seal plate 25 are provided between the duct plate 9 and a rear wall 4 of the cabinet 1. In the supply duct 15 is installed a duct member 21 for guiding the cool air blown by the fresh food compartment fan 13*b* downwardly. The cool air generated by the fresh food compartment evaporator 12*b* is blown by the fresh food compartment fan 13*b*, and then supplied to the fresh food compartment 3 via the supply duct 15 and the cool air discharge ports 16.

A cool air dispersing device 130 is installed in the supply duct 15. The cool air dispersing device 130 is comprised of a rotational shaft 131 having a vertical axis, cool air dispersing blades 132 assembled with the rotational shaft 131 in correspondence with the cool air discharge ports 16 respectively, and a driving motor 135 for rotating the rotational shaft 131. Each of the cool air dispersing blades 132 is comprised of three disc 136, 137 and 138 disposed in parallel with each other along the axis direction, and a first blade part 133 and a second blade part 134 disposed between the discs 136, 137 and 138. Each of the blade parts 133 and 134 are bent so that their cross section is a lax shape of alphabet S. The blade parts 133 and 134 are bent to the opposite directions to each other.

In the refrigerator having the above-described constitution, when the driving motor 135 rotates the rotational shaft 131 at a low speed, the cool air flowing along the supply duct 15 changes its flowing direction along the bent surface of the cool air dispersing blades 132, and is discharged into the fresh food compartment 3 to be dispersed horizontally. Meanwhile, when the concentrative cooling on a specific area is needed, the driving motor 135 stops the rotational shaft 131 in accordance with the direction of the cool air dispersing blades 132 so that the cool air is concentrated on the specific area.

However, in such a conventional refrigerator, the cool air discharge ports 16 are in open state always, so the cool air generated by the fresh food compartment evaporator 12*b* is always supplied into the fresh food compartment 3 irrespective of the temperature of the fresh food compartment 3. Thus, there is a problem that the fresh food compartment 3 can be overcooled. In particular, since a general refrigerator operates on the basis of the temperature of the freezing compartment 2, the possibility of overcooling of the fresh food compartment 3 always exists. More specifically, the compressor 11 begins to operate when the temperature of the freezing compartment 2 is higher than a temperature set by a user, by which the freezing compartment evaporator 12*a* as well as the fresh food compartment evaporator 12*b* generates the cool air. Accordingly, even though the temperature of the fresh food compartment 3 is lower than the temperature set by the user, the cool air is supplied into the fresh food compartment 3 through the cool air discharge ports 16, whereby the fresh food compartment 3 may be overcooled.

SUMMARY OF THE INVENTION

The present invention has been proposed to overcome the above-described problems in the prior art, and accordingly it is the object of he present invention to provide a refrigerator capable of changing the area to which cool air is supplied, by selectively opening or closing a cool air discharging port or ports and thereby the overcooling of the fresh food compartment is prevented.

To achieve the above object, the present invention provides a refrigerator comprising: a cooling compartment for storing food; a duct plate for forming a cool air duct in a rear wall of said cooling compartment, said duct plate having a plurality of cool air discharge ports opened into said cooling compartment; a plurality of shutter members being installed on said duct plate, said shutter members being capable of moving along a planar direction thereof between an open position for opening the cool air discharge ports and a close position for closing the cool air discharge ports; a driving motor for driving said shutter members; and a cam being rotated by said driving motor, said cam being contacted with said shutter members during rotation thereof so as to move said shutter members.

Here, said cool air discharge ports and shutter members are disposed symmetrically around said cam.

Preferably, the refrigerator according to the present invention further comprises springs for elastically pushing said shutter members to a direction against a movement of said shutter members caused by said cam. Said shutter members are normally positioned at the open position by said springs.

The movement of said shutter members is guided by guide members.

A plurality of temperature sensors are installed in said cooling compartment. Said driving motor stops said cam according to a sensing result of said temperature sensors so that closed is the cool air discharge port corresponding to an area of which temperature is low. Said driving motor is a stepping motor.

According to the present invention, the overcooling of the fresh food compartment can be prevented by opening/closing the cool air discharge ports, and the temperature of the fresh food compartment can reach a desired temperature in a short time. Furthermore, the cool air is not supplied into an area which has been properly cooled, so the cool air can be distributed uniformly.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Figure 1:
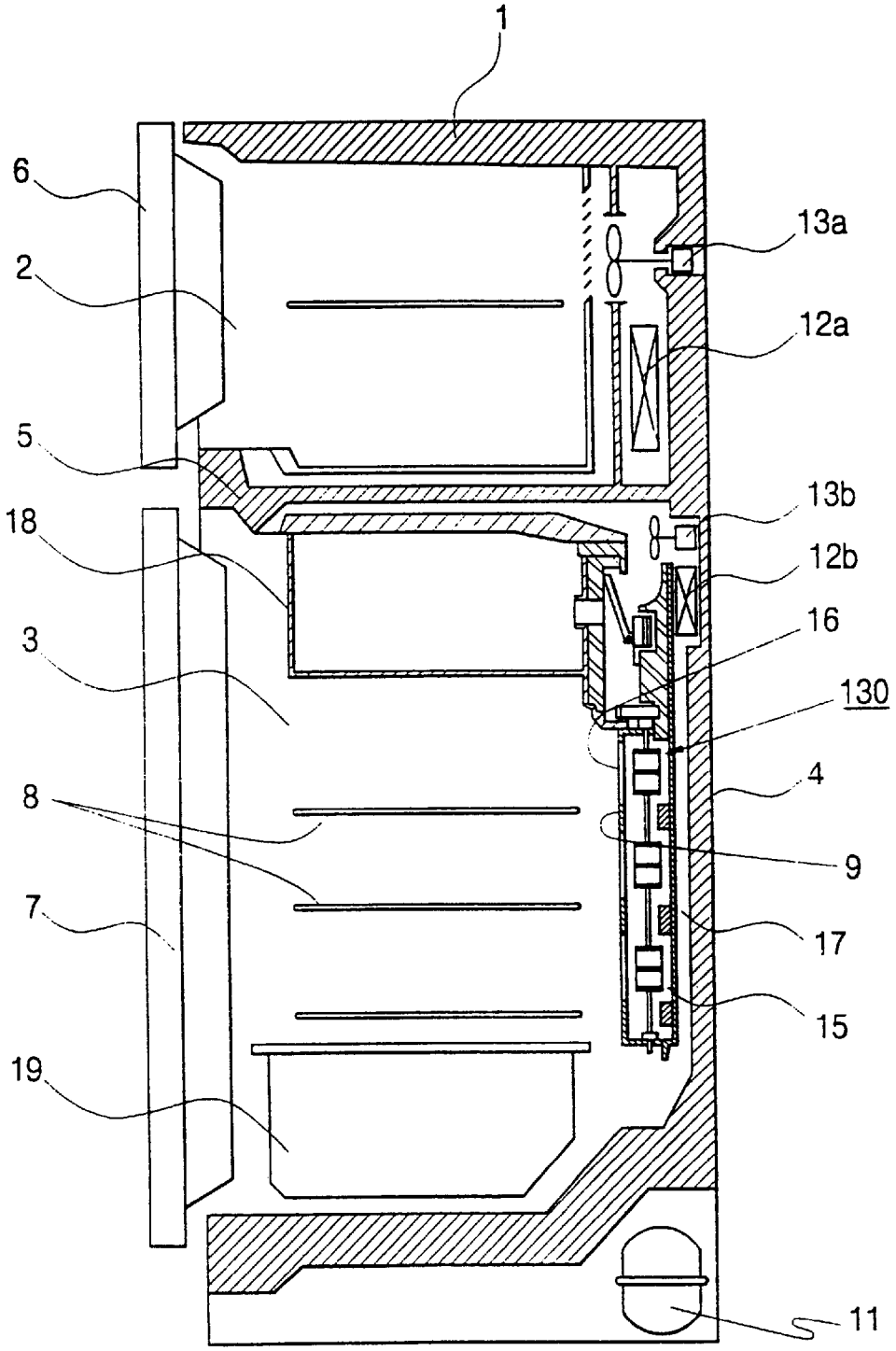
FIG. 1 (PRIOR ART)
FIG. 1 is a side sectional view of a conventional refrigerator having cool air dispersing blades.
Figure 2:
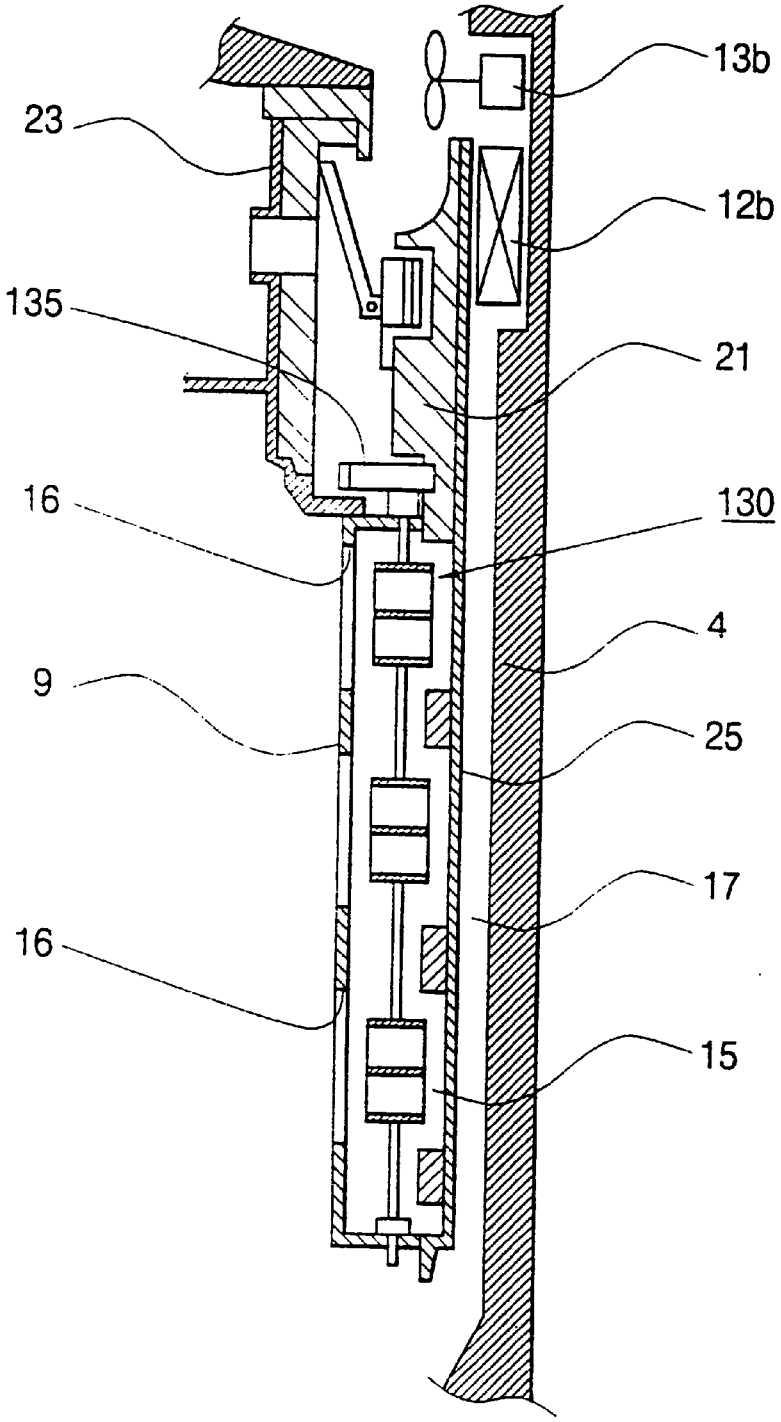
FIG. 2 (PRIOR ART)
FIG. 2 is a partial enlarged sectional view of FIG. 1.
Figure 3:
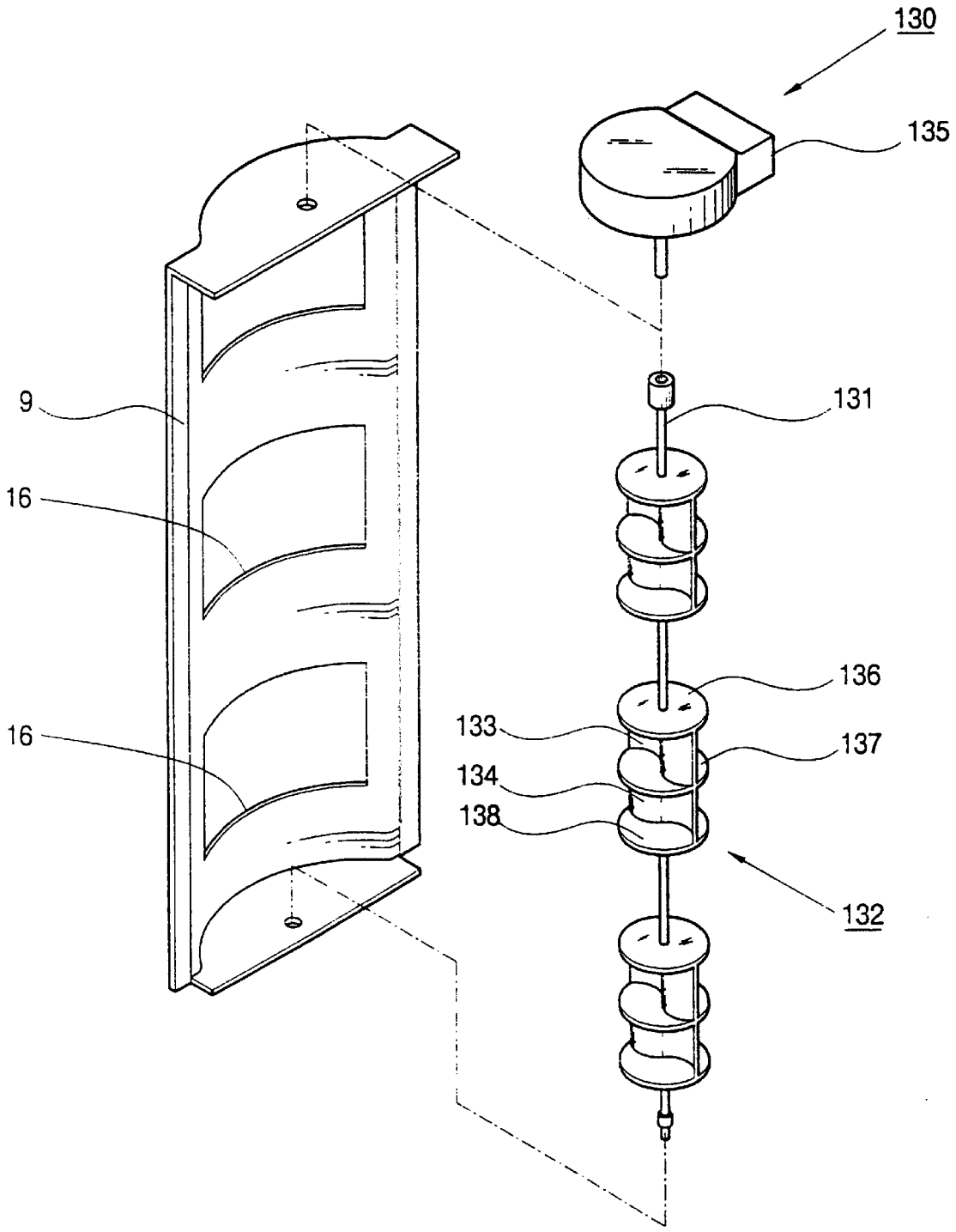
FIG. 3 (PRIOR ART)
FIG. 3 is an enlarged exploded perspective view of main elements of FIG. 2.

Hereinafter, the present invention will be described in detail with reference to the drawings; The same or similar parts with the parts shown in FIGS. 1 through 3 relating to the conventional art will be refereed to with the same reference numerals. The description of the parts in each embodiment which are substantially the same with the parts of the prior art will be omitted.

Figure 4:
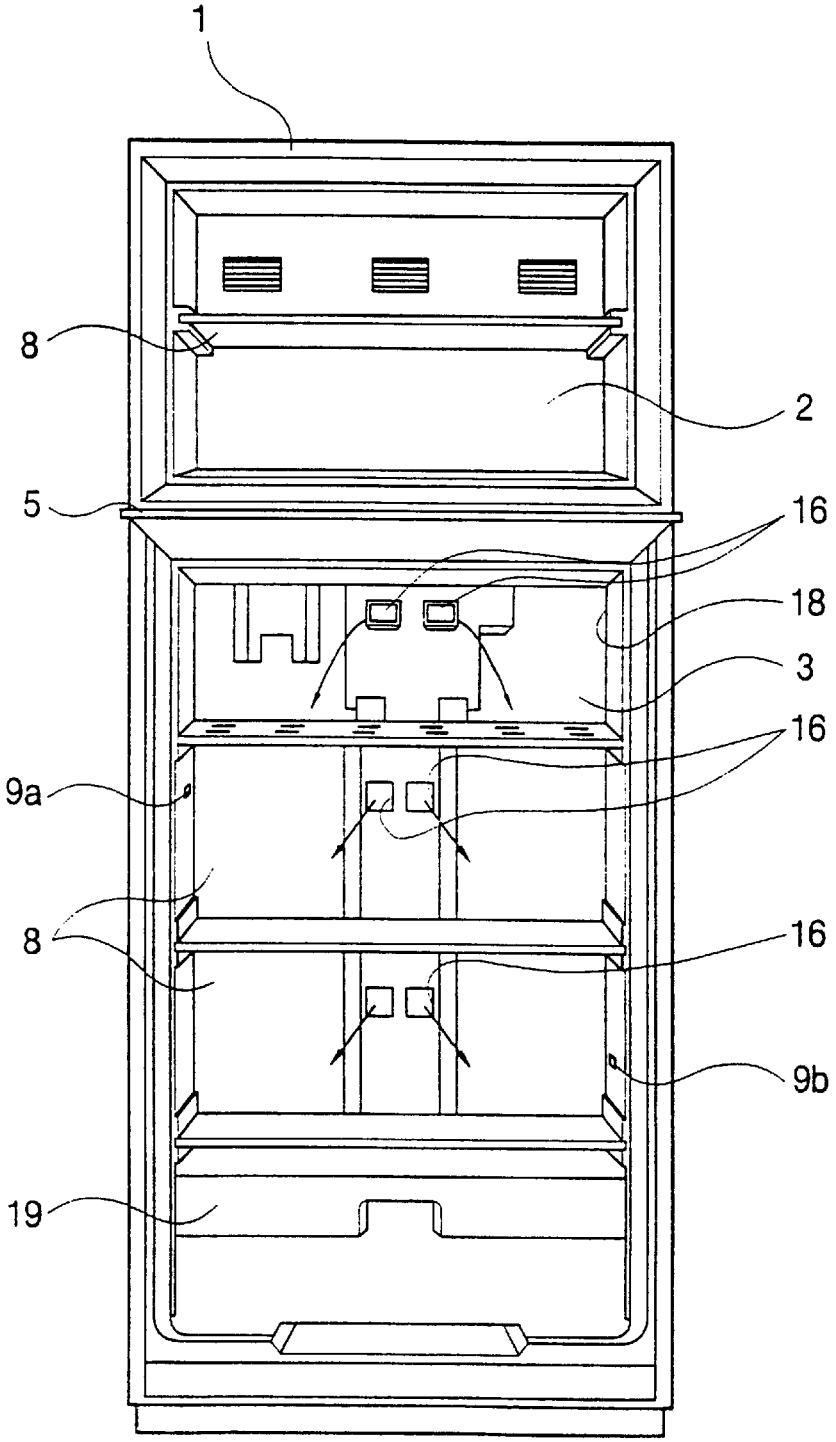
FIG. 4 is a front view of a refrigerator according to the present invention.
Figure 5:
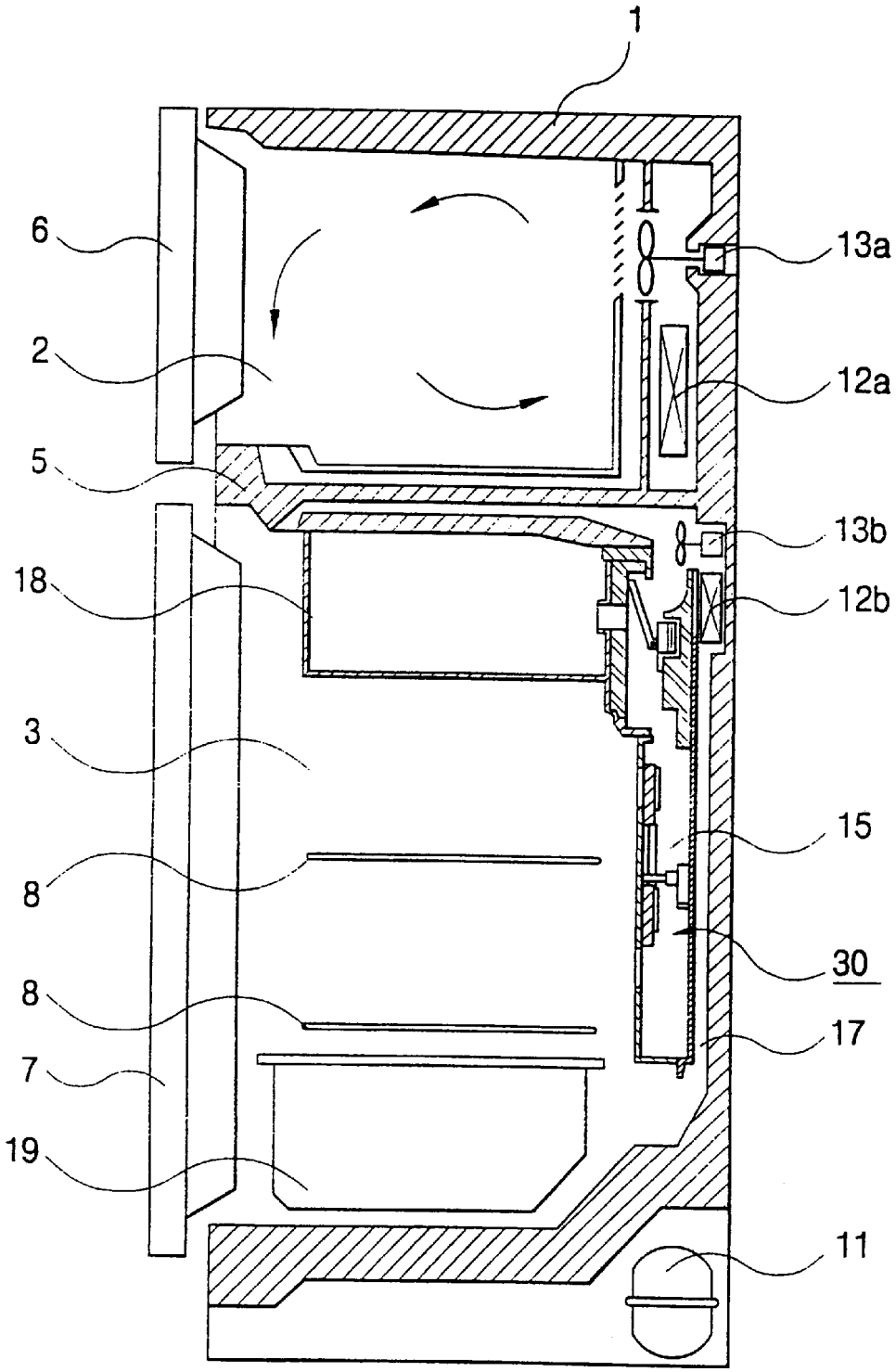
FIG. 5 is a side sectional view of FIG. 4.

FIG. 4 is a front view of a refrigerator according to the present invention, and FIG. 5 is a side sectional view of FIG. 4. The refrigerator has, as the conventional refrigerator which has been illustrated with reference to FIGS. 1 through 3, a cabinet 1 forming freezing compartment 2 and a fresh food compartment 3, which are partitioned by a partitioning wall 5 and are disposed upper and lower parts thereof, respectively. On the front openings of the freezing compartment 2 and the fresh food compartment 3, doors 6 and 7 for opening/closing them are installed respectively. In the fresh food compartment 3, shelves 8 for placing food thereon in installed, which divide the fresh food compartment 3 into three stratified area, i. e., an upper area, a middle area, and a lower area. A special fresh chamber 18 for storing food which are proper to a specific temperature range is formed at the upper part of the fresh food compartment 3, and a vegetable chamber 19 for storing vegetables is formed at the lower part of the fresh food compartment 3.

In the cabinet 1 is installed a cooling system comprising a compressor 11, a condenser (not shown), a freezing compartment evaporator 12*a*, and a fresh food compartment evaporator 12*b*. The cool air generated by the evaporators 12*a*and 12*b* is supplied into the corresponding cooling compartments 2 and 3 by the freezing compartment fan 13*a* and the fresh food compartment fan 13*b*.

A duct plate 9 is attached on the inner wall plate 23 forming the rear inner wall of the fresh food compartment 3. The duct plate 9 is formed into a partial cylinder shape so as to protrude at the shape of an arc from the inner wall plate 23 toward the fresh food compartment 3, and has cool air discharge ports 16 opened toward the respective storing areas of the fresh food compartment 3.

Between the duct plate 9 and the rear wall 4 of the cabinet 1, a supply duct 15 and a return duct 17 are provided, which are partitioned from each other by a seal plate 25. In the supply duct 15, a duct member 21 for guiding the cool air blown by the fresh food compartment fan 13*b* downwardly is installed. The cool air generated by the fresh food compartment evaporator 13*b* is blown by the fresh food compartment fan 13*b* so as to be supplied into the fresh food compartment 3 via the supply duct 15 and the cool air discharge ports 16. A device 30 for opening/closing the cool air discharge ports 16 is installed in the supply duct 15.

A pair of temperature sensors 9*a* and 9*b* are installed in the fresh food compartment 3. The temperature sensors 9*a* and 9*b* are installed at the upper left portion and lower right portion of the fresh food compartment 3, respectively.

Figure 6:
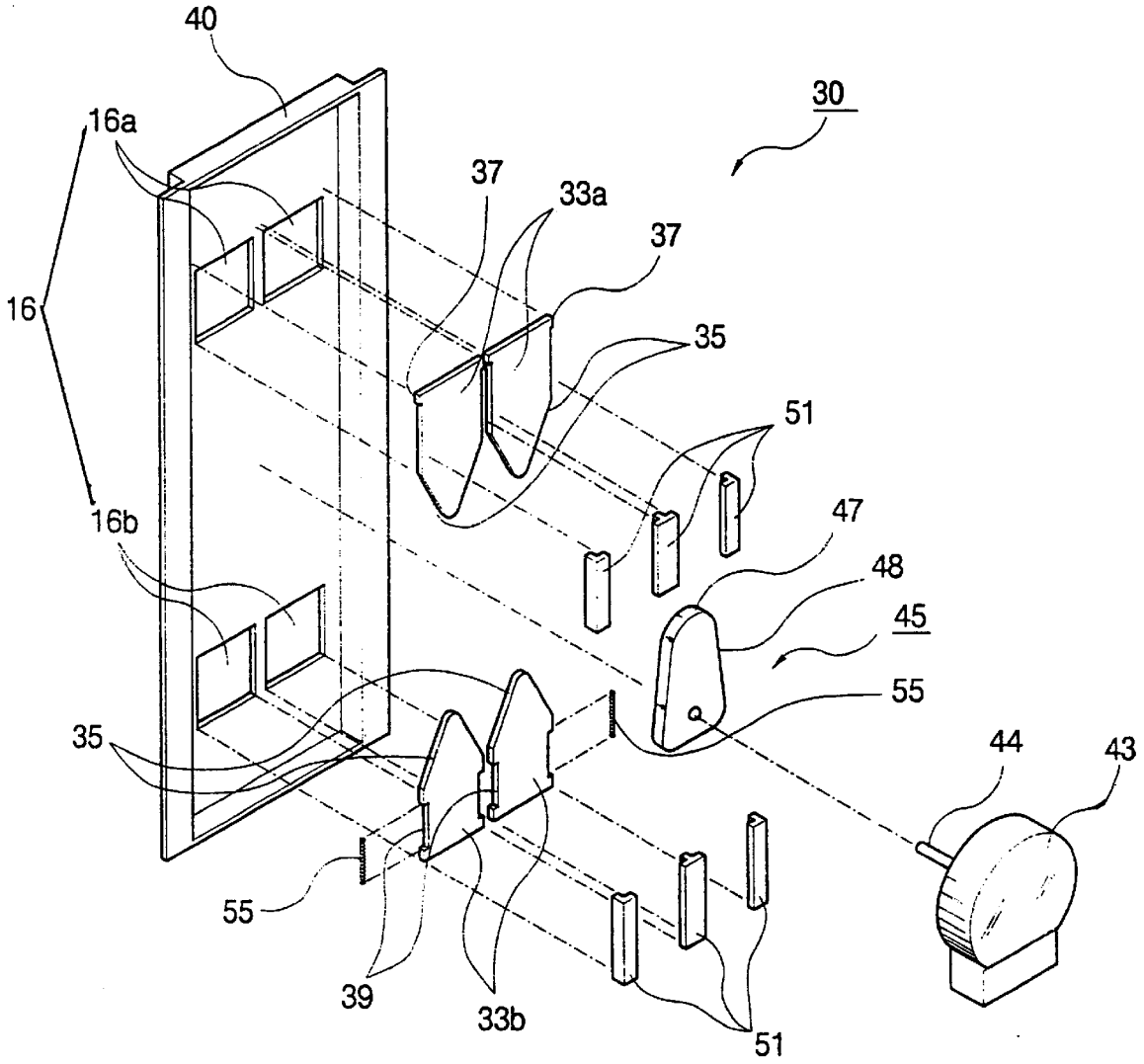
FIG. 6 is an enlarged exploded perspective view of the device for opening/closing the cool air discharge ports shown in FIG. 5.
Figure 7:
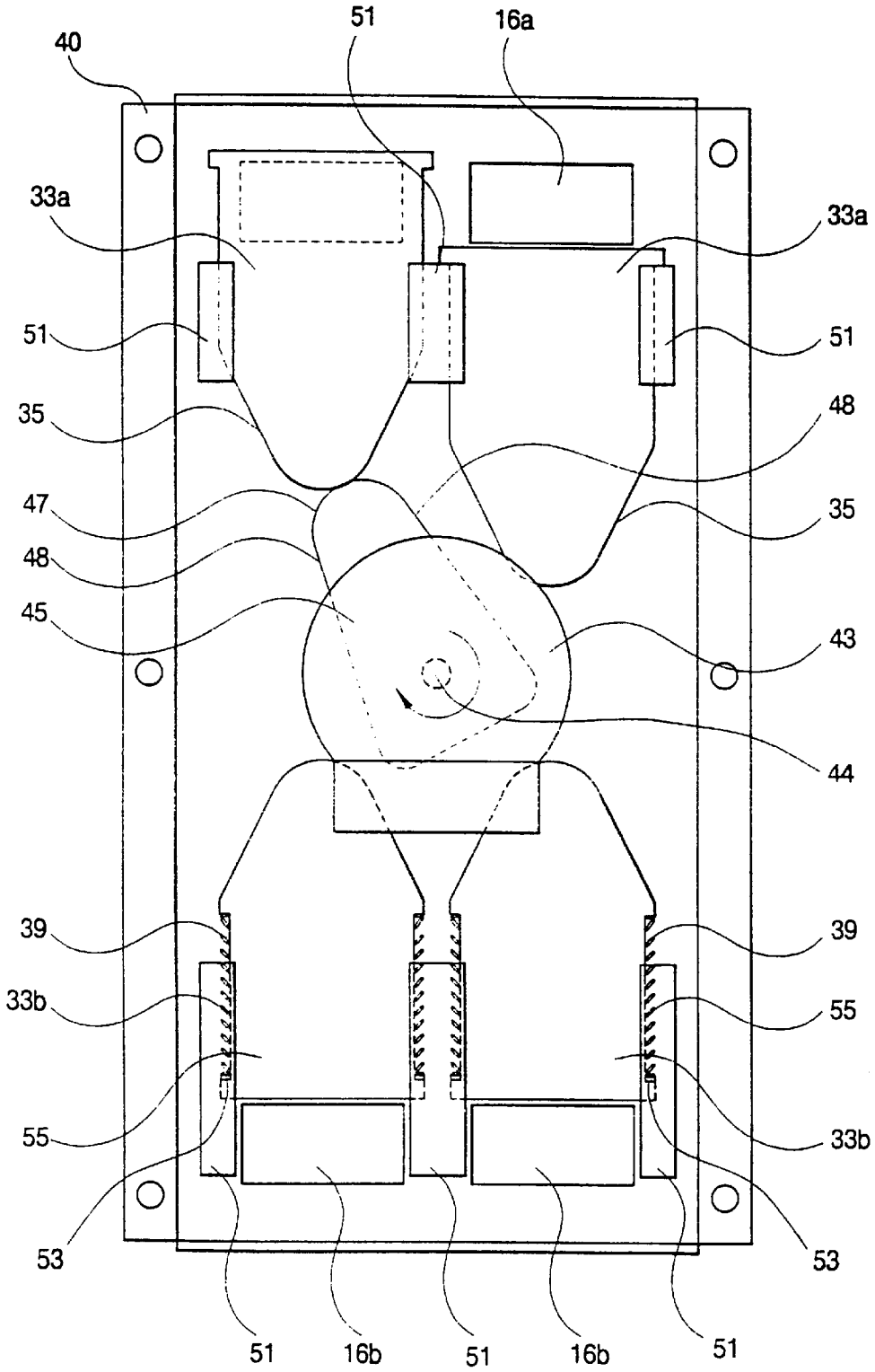
FIGS. 7 and 8 are rear views of the device of FIG. 6 in the assembled state.
Figure 8:
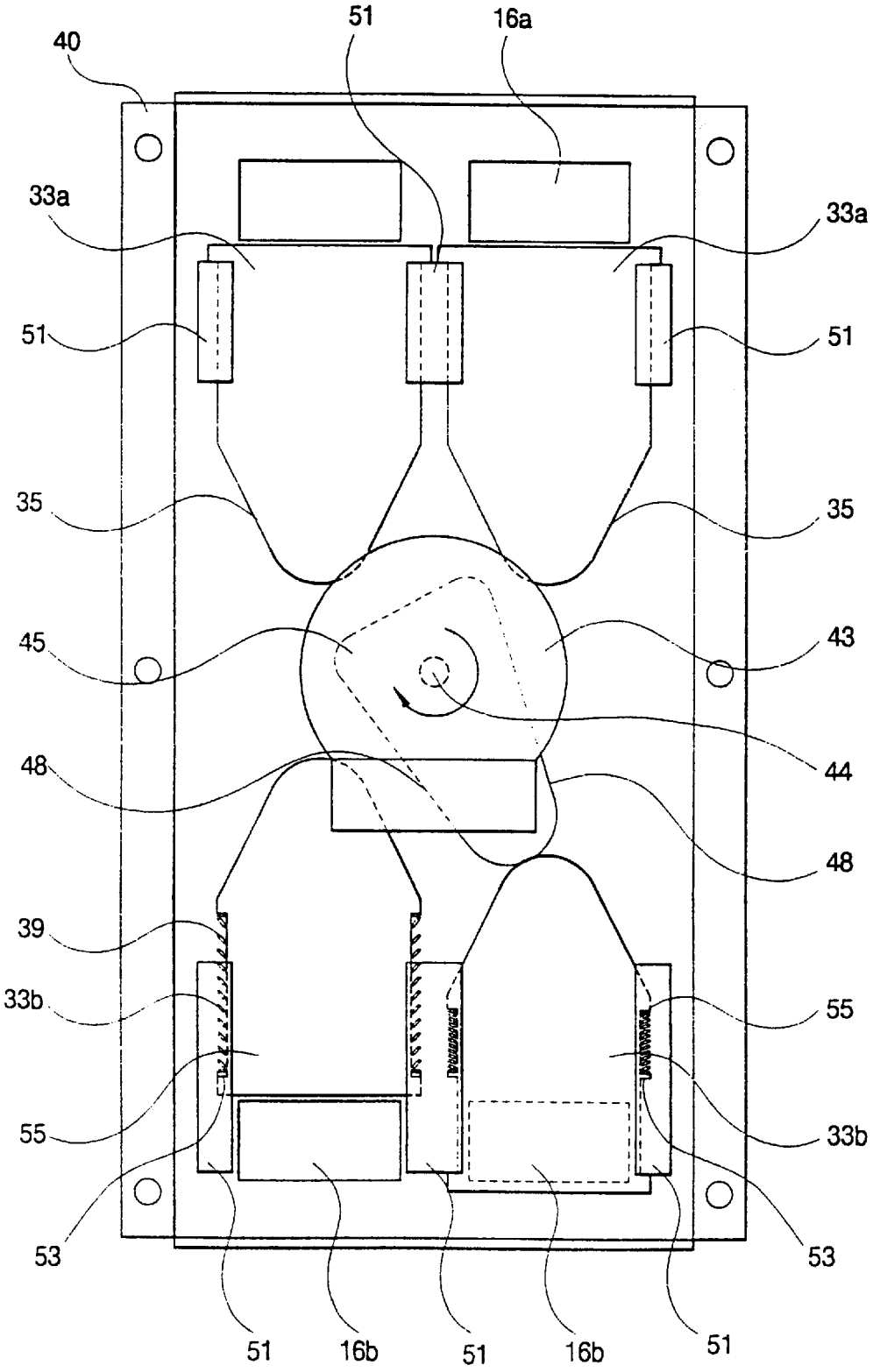

FIG. 6 is an enlarged exploded perspective view of the device 30 for opening/closing the cool air discharge ports shown in FIG. 5, and FIGS. 7 and 8 are rear views of the device of FIG. 6 in the assembled state.

The cool air discharge ports 16 are comprised of a pair upper ports 16*a* and a pair of lower ports 16*b*, and shutter members 33*a* and 33*b* are installed at the cool air discharge ports 16. The shutter member 33*a* and 33*b* are comprised of a pair of upper shutter members 33*a* corresponding to the upper ports 16*a*, and a pair of lower shutter members 33*b* corresponding to the lower ports 16*b*. Guide members 51 are installed near the cool air discharge ports 16, by which the shutter members 33*a* and 33*b* are guided to slide up and down.

Hooking protrusions 37 are formed at both side ends of the upper part of the respective upper shutter members 33*a*. The hooking protrusions 37 are hung on upper ends of the guide members 51 when the upper shutter members 33*a* move down, whereby the upper shutter members 33*a*are stopped not to move down further. The upper shutter members 33*a* are normally moved down by their own weight, so the upper shutter members 33*a*normally opens the upper ports 16*a*.

At both sides of each lower shutter member 33*b* are formed recess parts 39, and a spring 55 is disposed in each of the recess parts 39. The lower end of the spring 55 is supported by a hooking projection 53 formed on the inner side of the guide member 51. The lower shutter members 33*b* are pushed up elastically by the springs 55, whereby the lower shutter embers 33*b* normally open the lower ports 16*b*.

Each of the shutter members 33*a*and 33*b* has protrusion part 35 interacting with a cam surface 48 of a cam 45 which will be described below.

At the central area of two pairs of the shutter members 33*a*and 33*b* is installed a cam 45 rotated by a driving motor 43. Thus, the shutter members 33*a* and 33*b* and the cool air discharge ports 16 corresponding thereto are symmetrically disposed around the cam 45. The driving motor 43 is fixed to a predetermined position in the supply duct 15 by a bracket which is not shown, and the cam 45 is assembled with the shaft 44 of the driving motor 43. The driving motor 43 is a stepping motor which is capable of controlling a stop angular position thereof.

The cam 45 has an operation part 47 protruding sideward, and cam surfaces 48 at both sides thereof which interact with the shutter members 33*a* and 33*b*. As the driving motor 43 operates, the cam 45 and the shutter members 33*a*and 33*b* are contacted with each other and distanced from each other by turns repeatedly, whereby the shutter members 33*a* and 33*b* are moved up and down.

Hereinbelow, the operation and effect of the device 30 for opening/closing the cool air discharge ports 16 according to the present invention will be described.

When the driving motor 43 is driven by a microprocessor which is not shown, the cam 45 begins to rotate. As the cam 45 rotates, the cam surface 48 comes in contact with the protrusion 35 of the left upper shutter member 33*a*. As the cam 45 further rotates, the protrusion 35 of the left upper shutter member 33*a* and the operation part 47 of the cam 45 come in contact with each other as shown in FIG. 7, whereby the left upper shutter member 33*a*is moved up to close the left upper port 16*a*.

As the cam 45 further rotates, the cam 45 is distanced from the left upper shutter member 33*a*, and the left upper shutter member 33*a* is moved down by its own weight to pen the left upper port 16*a*. As the cam 45 further rotates, the right upper port 16*a* is closed and then opened by the right upper shutter member 33*a* according to the operation similar to the above-described operation.

Similarly, as the cam 45 further rotates, the cam 45 moves the right lower shutter member 33*b* against the elastic force of the spring 55, whereby the right lower port 16*b* is closed by the right lower shutter member 33*b* as shown in FIG. 8. Furthermore, as the cam 45 further rotates, the right lower port 16*b* is opened, and thereafter the left lower port 16*b* is closed and then opened. Therefore, as the cam 45 rotates continuously, the cool air discharge ports 16 are closed in turn by respective shutter members 33*a*and 33*b*.

The microprocessor senses the temperature in the fresh food compartment 3 through the temperature sensor 9*a*and 9*b*. When the microprocessor judges that the temperature of a specific are in the fresh food compartment 3 reaches a temperature set by a user, it drives the driving motor 43 so that one of the cool air discharge ports 16 corresponding to the specific are is closed by the shutter members 33*a*and 33*b*. For example, if the temperature of the upper left area of the fresh food temperature 3 sensed by the temperature sensors 9*a*and 9*b* reaches a desired temperature, the driving motor 43 stops the cam 45 as shown in FIG. 7. Then, the cool air is supplied into the fresh food compartment 3 through the cool air discharge ports 16 except for the left upper port 16*a*, whereby the temperature of the fresh food compartment 3 can reach the desired temperature in a short time.

As described, the driving motor 43 rotates the cam 45 continuously while the temperature of the fresh food compartment 3 is maintained uniform, and when specific area has been sufficiently cooled, the specific area is not cooled further and the other areas are supplied with much more amount of the cool air. Therefore, the overcooling of the fresh food compartment 3 can be prevented, and the cool air can be uniformly distributed.

Meanwhile, in the present embodiment, two temperature sensors 9*a*and 9*b* are diagonally disposed, however, the number and the positions of the temperature sensor can be changed in consideration of situation.

Furthermore, the cam 45 has a single operation part 47 in the present embodiment, however, the number and the positions of the operation part 47 can be changed properly, too. For example, a pair of operation parts can be formed at positions opposite to each other, or a pair of operation parts can be disposed so that they are distanced from each other by a predetermined angel. Accordingly, a plurality of cool air discharge ports 16 can be opened simultaneously, or the open degrees of respective cool air discharge ports 16 can be different from each other.

Furthermore, in the present embodiment, the cool air discharge ports 16 are normally opened by the shutter members 33*a* and 33*b* and are closed in turn while the cam 45 rotates, however, it is possible that they are normally closed by the shutter members 33*a*and 33*b* and are opened in turns while the cam 45 rotates. In such a case, the driving motor 43 will be controlled so that one of the cool air discharge ports 16 corresponding to a specific area is opened by the shutter members 33*a* and 33*b* when the rise in temperature of the specific area is sensed by the temperature sensors 9*a* and 9*b*. Therefore, the cool air can concentrated on the specific area of which the temperature has risen.

As described above, according to the present invention, the overcooling of the fresh food compartment 3 can be prevented by opening/closing the cool air discharge ports 16, and the temperature of the fresh food compartment 3 can reach a desired temperature in a short time. Furthermore, the cool air is concentrated on an area of which temperature has risen, or the cool air is not supplied into an area which has been properly cooled, so the cool air can be distributed uniformly.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A refrigerator comprising:

a cooling compartment for storing food;

a duct plate for forming a cool air duct in a rear wall of said cooling compartment, said duct plate having a plurality of cool air discharge ports opened into said cooling compartment;

a plurality of shutter members being installed on said duct plate, said shutter members being capable of moving along a planar direction thereof between an open position for opening respective ones of the cool air discharge ports and a close position for closing the respective cool air discharge ports;

biasing devices biasing respective ones of said shutter members to one of said open and close positions;

a driving motor for driving said shutter members; and a cam being rotated by said driving motor, said cam being contacted with said shutter members during rotation thereof so as to move said shutter members relative to one another, and against the bias of said biasing devices, said cool air discharge ports and said shutters arranged generally symmetrically around said cam.

2. The refrigerator as claimed in claim 1, wherein said shutter members are normally biased to the open position by said biasing devices.

3. The refrigerator as claimed in claim 1, further comprising guide members for guiding a movement of said shutter members.

4. The refrigerator as claimed in claim 1, further comprising a plurality of temperature sensors installed in said cooling compartment.

5. The refrigerator as claimed in claim 4, wherein said driving motor stops said cam according to a sensing result of said temperature sensors to close the cool air discharge port corresponding to an area whose temperature is low.

6. The refrigerator as claimed in claim 1, wherein said driving motor is a stepping motor.

7. The refrigerator as claimed in claim 1 wherein the biasing devices comprise springs.

8. A refrigerator comprising:

a cooling compartment for storing food;

a duct plate for forming a cool air duct in a rear wall of said cooling compartment, said duct plate having a plurality of cool air discharge ports opened into said cooling compartment for directing cool air to respective areas of said cooling compartment;

a plurality of shutter members being installed on said duct plate, said shutter members being capable of moving along a planar direction thereof between an open position for opening the cool air discharge ports and a close position for closing the cool air discharge ports;

a driving motor for driving said shutter members;

a cam being rotated by said driving motor, said cam being contacted with said shutter members during rotation thereof so as to move said shutter member; and a plurality of temperature sensors installed in said cooling compartment, for detecting temperatures of respective ones of said areas;

said driving motor being operably connected to said temperature sensors to selectively close a cool air discharge port associated with an area whose temperature is low.

* * * * *